US012480523B2

(12) United States Patent
Furutani

(10) Patent No.: US 12,480,523 B2
(45) Date of Patent: Nov. 25, 2025

(54) CENTRIFUGAL FAN

(71) Applicants: KABUSHIKI KAISHA TOSHIBA, Tokyo (JP); Toshiba Carrier Corporation, Kawasaki (JP)

(72) Inventor: Yuki Furutani, Hiratsuka (JP)

(73) Assignees: KABUSHIKI KAISHA TOSHIBA, Tokyo (JP); Toshiba Carrier Corporation, Kawasaki (JP)

( * ) Notice: Subject to any disclaimer, the term of this patent is extended or adjusted under 35 U.S.C. 154(b) by 0 days.

(21) Appl. No.: 18/592,685

(22) Filed: Mar. 1, 2024

(65) Prior Publication Data

US 2024/0410386 A1 Dec. 12, 2024

(30) Foreign Application Priority Data

Jun. 12, 2023 (JP) ..... 2023-096344

(51) Int. Cl.
*F04D 29/30* (2006.01)
*F04D 1/00* (2006.01)
*F04D 29/28* (2006.01)

(52) U.S. Cl.
CPC ..... *F04D 29/30* (2013.01); *F04D 1/00* (2013.01); *F04D 29/281* (2013.01)

(58) Field of Classification Search
CPC ..... F04D 29/384; F04D 29/30; F04D 29/281
See application file for complete search history.

(56) References Cited

U.S. PATENT DOCUMENTS 5,213,473 A * 5/1993 Fiala ..... F01D 5/048 416/185
9,261,107 B2 * 2/2016 Kim ..... F04D 29/30
11,988,221 B2 * 5/2024 Yan ..... F04D 29/284
2017/0234331 A1 8/2017 Kurihara et al.
2020/0088208 A1 * 3/2020 Liu ..... F04D 29/242

FOREIGN PATENT DOCUMENTS

JP 10-299694 11/1998
JP 2008-064044 A 3/2008
JP WO 2016/113900 A1 7/2016
JP 2017-125408 A 7/2017
JP 2022-038702 A 3/2022

* cited by examiner

*Primary Examiner* — Michael L Sehn
(74) *Attorney, Agent, or Firm* — Oblon, McClelland, Maier & Neustadt, L.L.P.

(57) ABSTRACT

A centrifugal fan includes a back plate, a shroud, and multiple blades. The multiple blades include first to third blades. The first to third blades include first to third leading edge parts and first to third trailing edge parts. First to third lengths are the length from the first to third leading edge parts to the first to third trailing edge parts. The second length is greater than the first length. The third length is greater than the second length. The numbers of the first to third blades are equal. The total number of the multiple blades is a multiple of 3, and is not less than 6. The first to third blades are arranged in a rotation direction in the order of the first blade, the second blade, and the third blade.

4 Claims, 6 Drawing Sheets

CENTRIFUGAL FAN

CROSS-REFERENCE TO RELATED APPLICATIONS

This application is based upon and claims the benefit of priority from Japanese Patent Application No. 2023-096344, filed on Jun. 12, 2023; the entire contents of which are incorporated herein by reference.

FIELD

Embodiments described herein relate generally to a centrifugal fan.

BACKGROUND

Centrifugal fans are known to be used in heat exchangers and the like. It is desirable for such a centrifugal fan to increase static pressure, which corresponds to the differential pressure before and after passing through the centrifugal fan. To increase the static pressure, it may be considered to increase the blade length. However, the blades become heavier as the blade length increases, which may cause vibrations when rotating. Lengthening the blades also may increase material costs.

DETAILED DESCRIPTION

Figure 1:
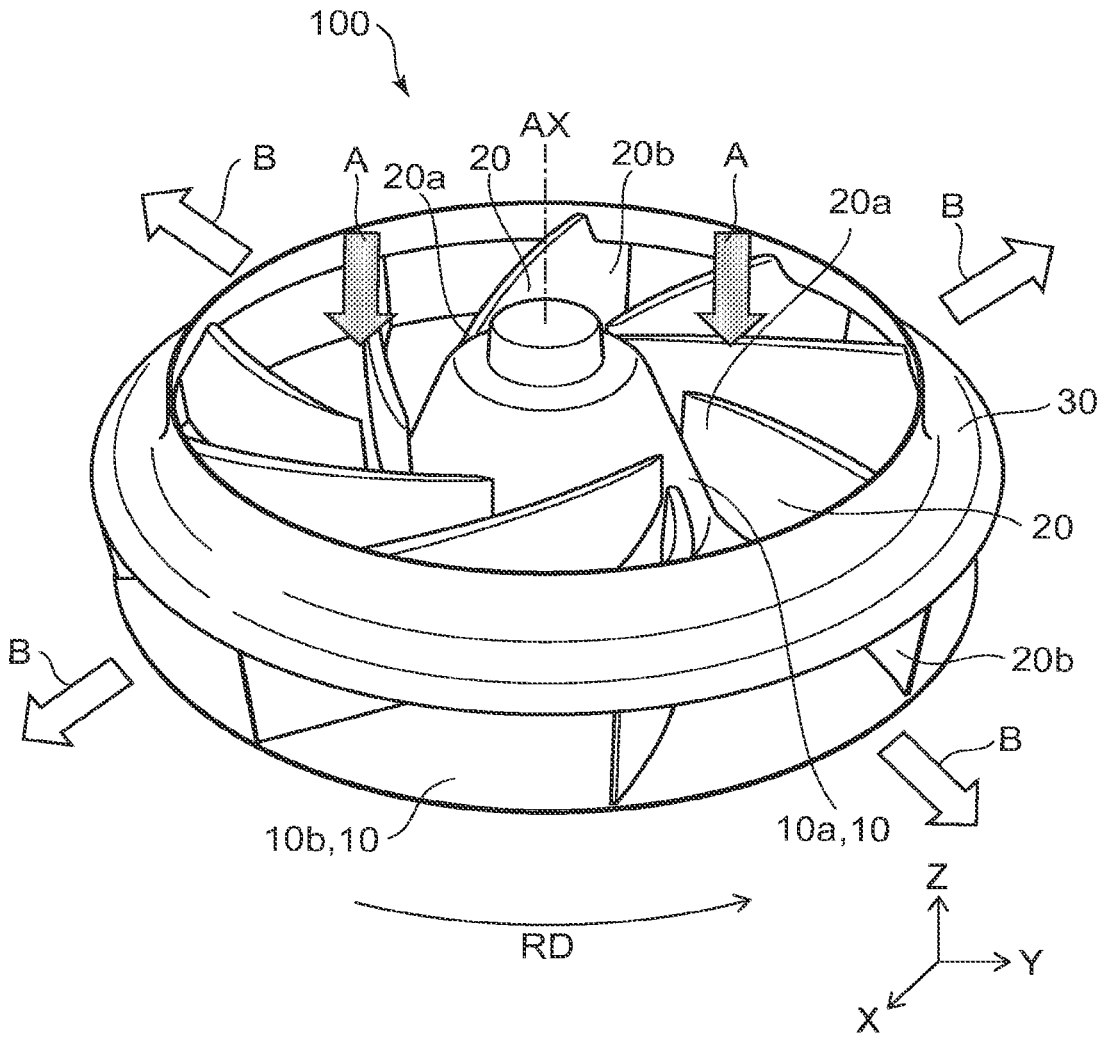
FIG. 1 is a perspective view illustrating a centrifugal fan according to an embodiment.

A centrifugal fan according to an embodiment includes a back plate rotating around a rotation axis, a shroud, and multiple blades located between the back plate and the shroud. The back plate includes a central part and an outer circumference part; and the outer circumference part is positioned outward of the central part. The multiple blades include a first blade, a second blade, and a third blade. The first blade includes a first leading edge part, which is an end part at the central part side, and a first trailing edge part, which is an end part at the outer circumference part side. The second blade includes a second leading edge part, which is an end part at the central part side, and a second trailing edge part, which is an end part at the outer circumference part side. The third blade includes a third leading edge part, which is an end part at the central part side, and a third trailing edge part, which is an end part at the outer circumference part side. A first length is the length from the first leading edge part to the first trailing edge part; a second length is the length from the second leading edge part to the second trailing edge part; a third length is the length from the third leading edge part to the third trailing edge part; and the second length is greater than the first length. The third length is greater than the second length. The number of the first blades, the number of the second blades, and the number of the third blades are equal. The total number of the multiple blades is a multiple of 3, and is not less than 6; and the first blade, the second blade, and the third blade are arranged in a rotation direction in the order of the first blade, the second blade, and the third blade.

Exemplary embodiments will now be described with reference to the drawings.

The drawings are schematic or conceptual; and the relationships between the thickness and width of portions, the proportional coefficients of sizes among portions, etc., are not necessarily the same as the actual values thereof. Furthermore, the dimensions and proportional coefficients may be illustrated differently among drawings, even for identical portions.

In the specification of the application and the drawings, components similar to those described in regard to a drawing thereinabove are marked with like reference numerals; and a detailed description is omitted as appropriate.

FIG. 1 is a perspective view illustrating a centrifugal fan according to an embodiment.

As illustrated in FIG. 1, the centrifugal fan 100 according to the embodiment includes a back plate 10, multiple blades 20, and a shroud 30.

The back plate 10 rotates in a rotation direction RD around a rotation axis AX. The rotation axis extends along a Z-direction. The back plate 10 rotates along an X-Y plane orthogonal to the Z-direction. The X-Y plane is a plane along an X-direction, which is orthogonal to the Z-direction, and a Y-direction, which is orthogonal to the Z-direction and X-direction. In the example, the rotation direction RD is oriented counterclockwise in the direction from the shroud 30 toward the back plate 10.

The back plate 10 includes a central part 10*a* and an outer circumference part 10*b*. The central part 10*a* includes an intersection between the rotation axis AX and the back plate 10. The central part 10*a* protrudes in the Z-direction. The outer circumference part 10*b* is positioned outward of the central part 10*a*. The outer circumference part 10*b* spreads along the X-Y plane.

The multiple blades 20 are located between the back plate 10 and the shroud 30. The multiple blades 20 are interposed between the back plate 10 and the shroud 30. For example, the multiple blades 20 each extend along the Z-direction. For example, the multiple blades 20 each may be tilted with respect to the Z-direction.

The multiple blades 20 each extend from the central part 10*a* toward the outer circumference part 10*b* of the back plate 10. Each of the multiple blades 20 includes a leading edge part 20*a*, which is an end part at the central part 10*a* side, and a trailing edge part 20*b*, which is an end part at the outer circumference part 10*b* side. For example, the multiple blades 20 each extend to be curved from the leading edge part 20*a* toward the trailing edge part 20*b*. For example, the multiple blades 20 each may extend linearly from the leading edge part 20*a* toward the trailing edge part 20*b*.

The shroud 30 covers the trailing edge parts 20*b* of the multiple blades 20 in the Z-direction. The trailing edge parts 20*b* of the multiple blades 20 are positioned between the back plate 10 and the shroud 30 in the Z-direction. The shroud 30 is connected to the trailing edge parts 20*b* of the multiple blades 20. The shroud 30 does not cover the leading edge parts 20*a* of the multiple blades 20 in the Z-direction. The shroud 30 does not include a surface overlapping the rotation axis AX in the Z-direction.

As the back plate 10 rotates, the multiple blades 20 and the shroud 30 rotate together with the back plate 10. As a result, the multiple blades 20 draw air along the Z-direction as illustrated by arrows A in FIG. 1, and generate a flow of air (airflow) along the X-Y plane from between the shroud 30 and the back plate 10 outward from the centrifugal fan 100 as illustrated by arrows B in FIG. 1.

The multiple blades 20 will now be described in more detail.

Figure 2:
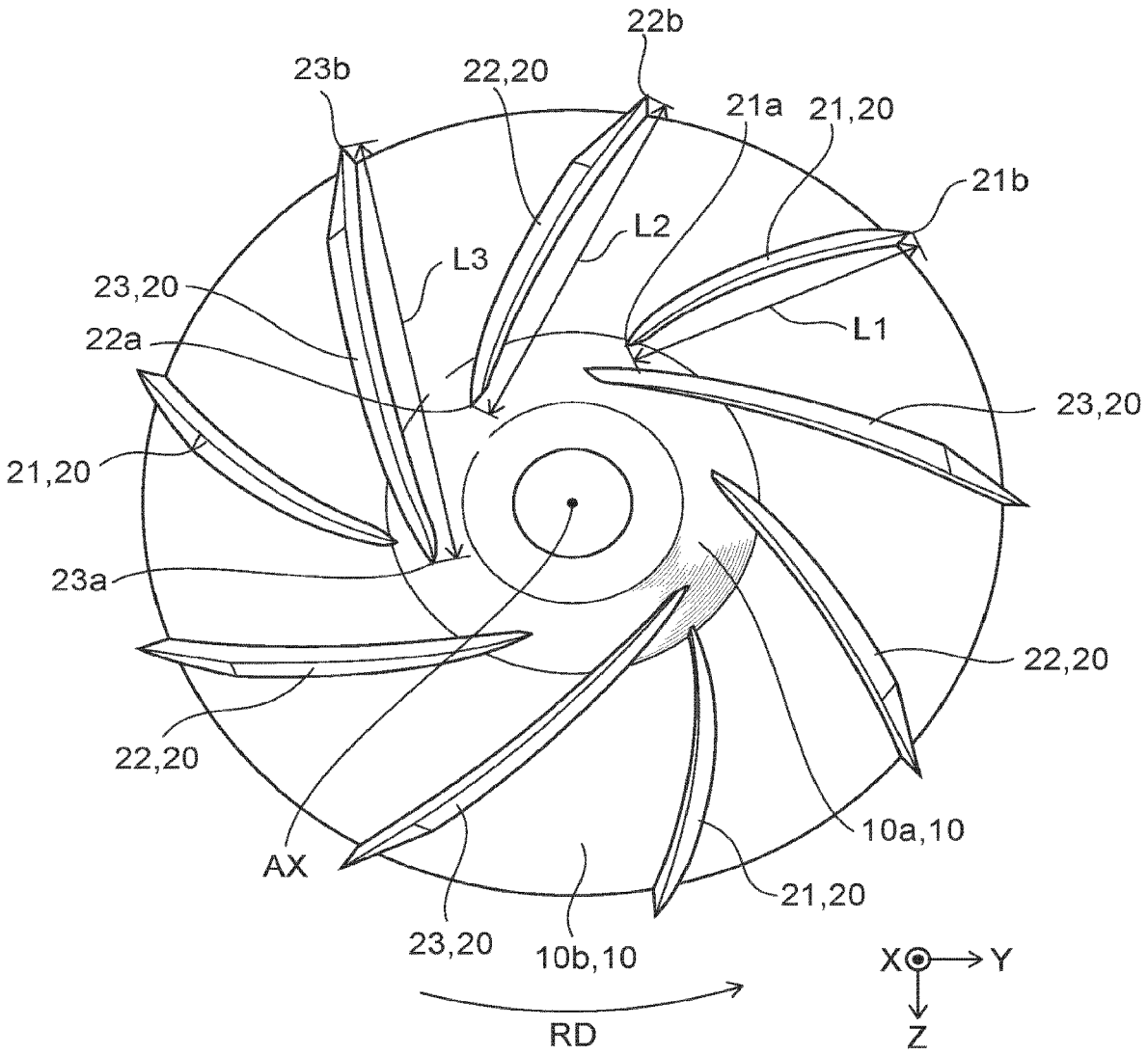
FIG. 2 is a plan view illustrating the centrifugal fan according to the embodiment.

FIG. 2 is a plan view illustrating the centrifugal fan according to the embodiment.

The shroud 30 is not illustrated in FIG. 2.

As illustrated in FIG. 2, the multiple blades 20 include a first blade 21, a second blade 22, and a third blade 23.

The first blade 21 includes a first leading edge part 21*a* and a first trailing edge part 21*b*. The first leading edge part 21*a* is the end part at the central part 10*a* side. The first trailing edge part 21*b* is the end part at the outer circumference part 10*b* side. The length from the first leading edge part 21*a* to the first trailing edge part 21*b* is a first length L1.

The second blade 22 includes a second leading edge part 22*a* and a second trailing edge part 22*b*. The second leading edge part 22*a* is the end part at the central part 10*a* side. The second trailing edge part 22*b* is the end part at the outer circumference part 10*b* side. The length from the second leading edge part 22*a* to the second trailing edge part 22*b* is a second length L2. The second length L2 is greater than the first length L1.

The third blade 23 includes a third leading edge part 23*a* and a third trailing edge part 23*b*. The third leading edge part 23*a* is the end part at the central part 10*a* side. The third trailing edge part 23*b* is the end part at the outer circumference part 10*b* side. The length from the third leading edge part 23*a* to the third trailing edge part 23*b* is a third length L3. The third length L3 is greater than the second length L2.

The first length L1 is, for example, not more than 0.9 times, and favorably not less than 0.5 times and not more than 0.8 times the second length L2. The third length L3 is, for example, not less than 1.1 times, and favorably not less than 1.2 times and not more than 2.0 times the second length L2.

Thus, the centrifugal fan 100 according to the embodiment includes three types of blades 20 (the first blade 21, the second blade 22, and the third blade 23) having mutually-different lengths from the leading edge part 20*a* to the trailing edge part 20*b*.

In the centrifugal fan 100 according to the embodiment, the first blade 21, the second blade 22, and the third blade 23 are arranged in the rotation direction RD in the order of the first blade 21, the second blade 22, and the third blade 23. The example includes three sets of the three types of blades 20 arranged in the rotation direction RD in the order of the first blade 21, the second blade 22, and the third blade 23.

The number of the first blades 21, the number of the second blades 22, and the number of the third blades 23 are equal. The total number of the multiple blades 20 is a multiple of 3, and is not less than 6. That is, the number of the first blades 21, the number of the second blades 22, and the number of the third blades 23 each are, for example, not less than 2. The example includes three first blades 21, three second blades 22, and three third blades 23. That is, in the example, the total number of the multiple blades 20 is 9. It is favorable for the total number of the multiple blades 20 to be odd.

The length of the first blade 21 in the extension direction of the first blade 21 (i.e., the direction from the first leading edge part 21*a* toward the first trailing edge part 21*b* along the first blade 21) when viewed along the Z-direction is less than the length of the second blade 22 in the extension direction of the second blade 22 (i.e., the direction from the second leading edge part 22*a* toward the second trailing edge part 22*b* along the second blade 22) when viewed along the Z-direction and less than the length of the third blade 23 in the extension direction of the third blade 23 (i.e., the direction from the third leading edge part 23*a* toward the third trailing edge part 23*b* along the third blade 23) when viewed along the Z-direction. The length in the extension direction of each blade is taken to be, for example, the length of the center line between one surface (the surface on which positive pressure is applied when rotating) and another surface (the surface on which negative pressure is applied when rotating) in a cross section along the Z-direction of each blade.

By including the three types of blades 20 (the first blade 21, the second blade 22, and the third blade 23) having mutually-different lengths from the leading edge part 20*a* to the trailing edge part 20*b*, for example, the blades tend to be lighter than when all of blades are the third blades 23. Vibrations when rotating can be suppressed thereby. Also, an increase of the material cost can be suppressed compared to when all of blades are the third blades 23.

By arranging the first blade 21, the second blade 22, and the third blade 23 in the rotation direction RD in the order of the first blade 21, the second blade 22, and the third blade 23, the flow path between the second blade 22 and the third blade 23 tends to be less narrow than, for example, an arrangement in the rotation direction RD in the order of the third blade 23, the second blade 22, and the first blade 21; therefore, the flow path resistance does not increase easily in the flow path between the second blade 22 and the third blade 23. The static pressure can be increased thereby. Also, by arranging the first blade 21, the second blade 22, and the third blade 23 in the rotation direction RD in the order of the first blade 21, the second blade 22, and the third blade 23, for example, the static pressure can be increased particularly when the airflow rate is relatively small (e.g., in the range of 1,500 to 1,750 $m^3/h$).

Setting the total number of the multiple blades 20 to an odd number can suppress the occurrence of periodic noise (NZ noise) compared to when the total number of the multiple blades 20 is an even number. By setting the total number of the multiple blades 20 to be 9, the static pressure can be greater than when the total number of the multiple blades 20 is 6 or 12.

The placement angles of the first to third blades 21 to 23 will now be described in more detail.

Figure 3:
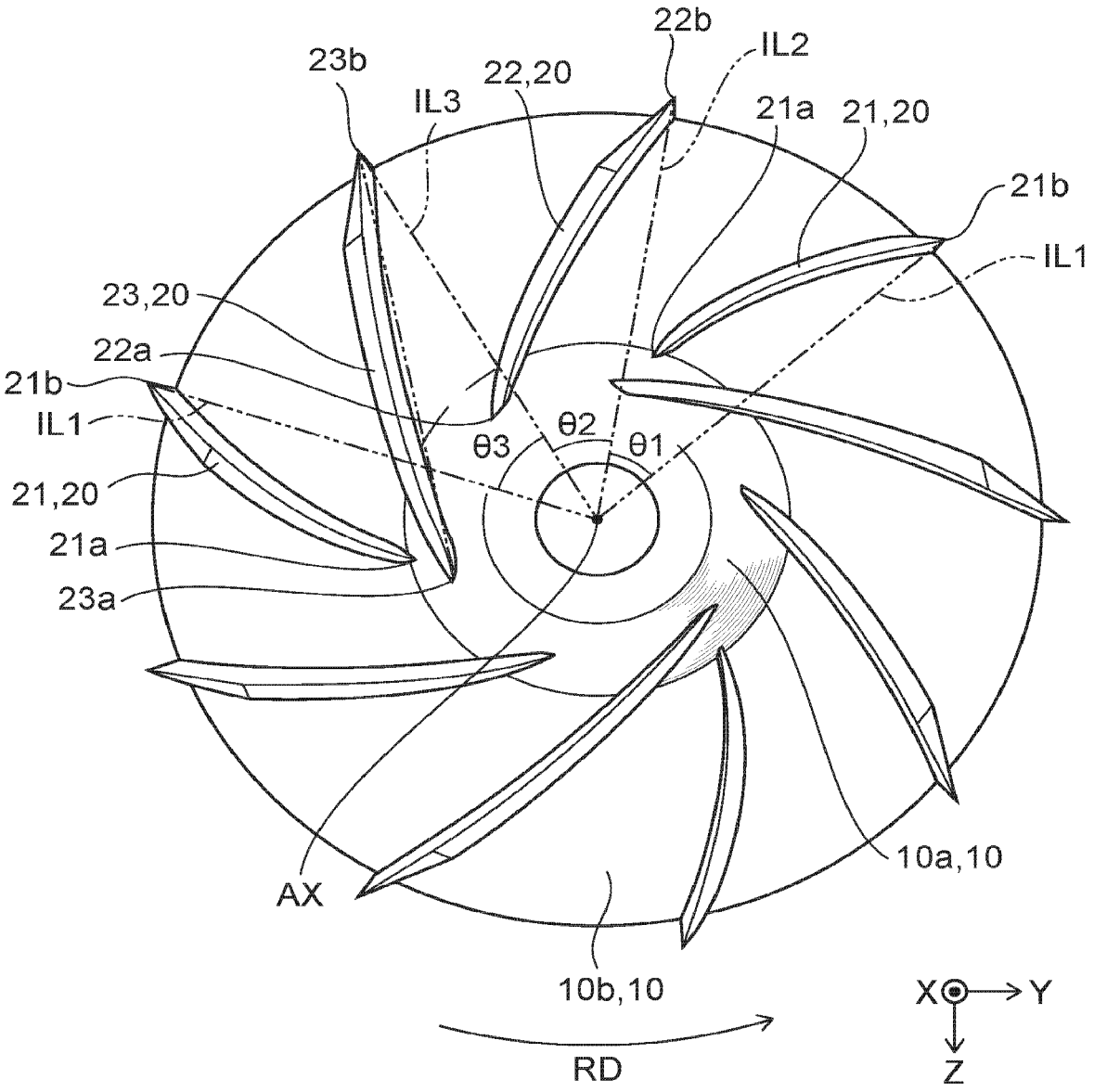
FIG. 3 is a plan view illustrating the centrifugal fan according to the embodiment.

FIG. 3 is a plan view illustrating the centrifugal fan according to the embodiment.

The shroud 30 is not illustrated in FIG. 3.

As illustrated in FIG. 3, the straight line that connects the rotation axis AX and the first trailing edge part 21*b* of the first blade 21 is taken as a first virtual line IL1. The straight line that connects the rotation axis AX and the second trailing edge part 22*b* of the second blade 22 is taken as a second virtual line IL2. The straight line that connects the rotation axis AX and the third trailing edge part 23*b* of the third blade 23 is taken as a third virtual line IL3.

The angle (the minor angle) between the first virtual line IL1 and the second virtual line IL2 adjacent to each other is taken as a first placement angle θ1. The angle (the minor angle) between the second virtual line IL2 and the third virtual line IL3 adjacent to each other is taken as a second placement angle θ2. The angle (the minor angle) between the third virtual line IL3 and the first virtual line IL1 adjacent to each other is taken as a third placement angle θ3.

In the centrifugal fan 100 according to the embodiment, for example, the third placement angle θ3 is greater than at least one of the first placement angle θ1 or the second placement angle θ2. For example, when the third placement angle θ3 is greater than the first placement angle θ1, the third placement angle θ3 may be greater than the second placement angle θ2, equal to the second placement angle θ2, or less than the second placement angle θ2. For example, when the third placement angle θ3 is greater than the second placement angle θ2, the third placement angle θ3 may be greater than the first placement angle θ1, equal to the first placement angle θ1, or less than the first placement angle θ1. The second placement angle θ2 may be greater than the first placement angle θ1, equal to the first placement angle θ1, or less than the first placement angle θ1. In the example, the third placement angle θ3 is greater than the first placement angle θ1 and greater than the second placement angle θ2. In the example, the second placement angle θ2 is greater than the first placement angle θ1.

When the third placement angle θ3 is greater than the first placement angle θ1, the difference between the third placement angle θ3 and the first placement angle θ1 is, for example, not less than 1° and not more than 5°. When the third placement angle θ3 is greater than the second placement angle θ2, the difference between the third placement angle θ3 and the second placement angle θ2 is, for example, not less than 1° and not more than 5°.

By setting the third placement angle θ3 to be greater than at least one of the first placement angle θ1 or the second placement angle θ2, the flow path between the first blade 21 and the third blade 23 tends to be less narrow than when the third placement angle θ3 is not more than the first placement angle θ1, or when the third placement angle θ3 is not more than the second placement angle θ2; therefore, the flow path resistance does not increase easily in the flow path between the first blade 21 and the third blade 23. The static pressure can be increased thereby.

The thicknesses of the first to third blades 21 to 23 will now be described in more detail.

Figure 4:
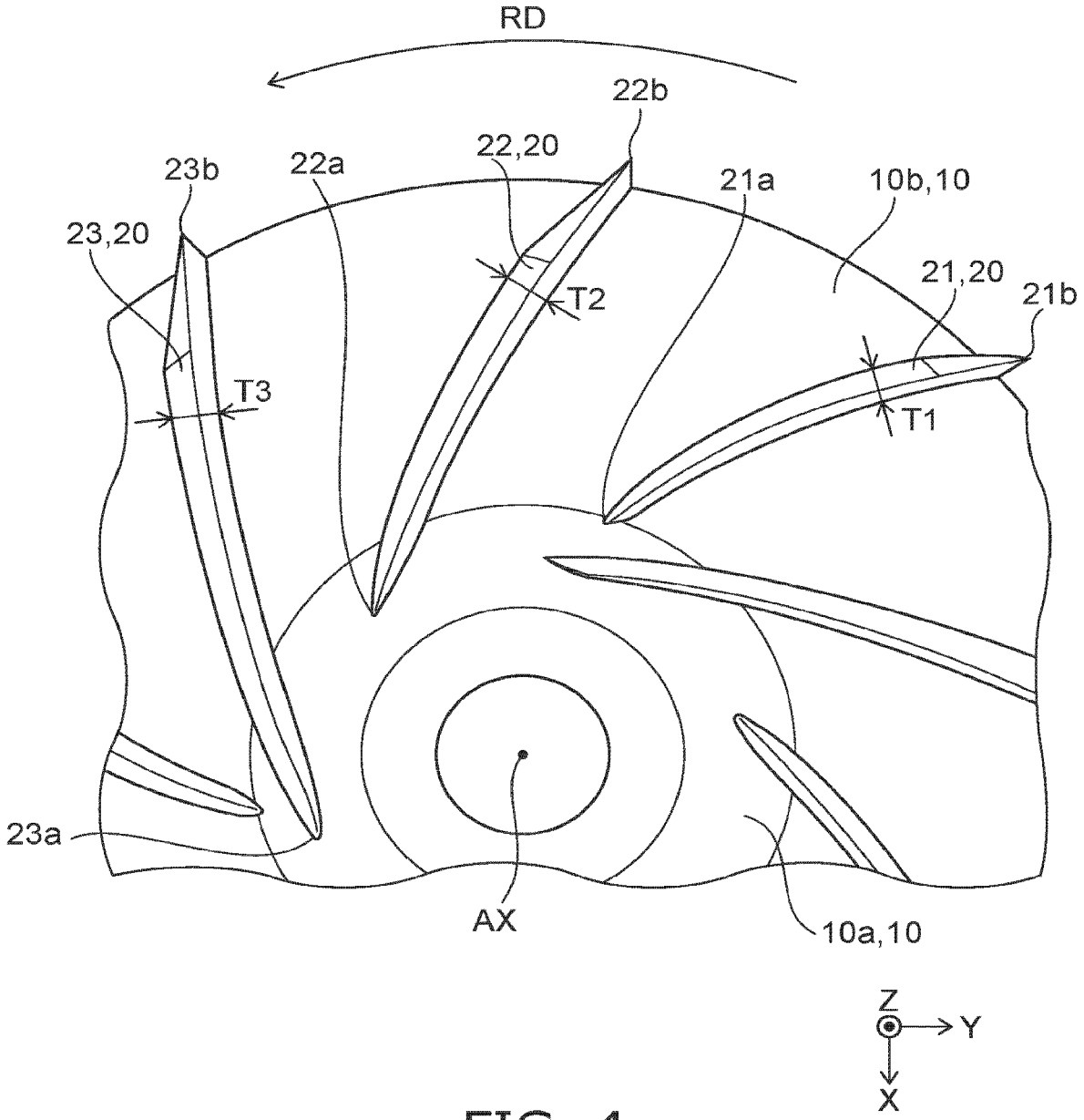
FIG. 4 is a plan view illustrating a part of the centrifugal fan according to the embodiment.

FIG. 4 is a plan view illustrating a part of the centrifugal fan according to the embodiment.

The shroud 30 is not illustrated in FIG. 4.

As illustrated in FIG. 4, the maximum thickness of the first blade 21 is taken as a first maximum thickness T1. The maximum thickness of the second blade 22 is taken as a second maximum thickness T2. The maximum thickness of the third blade 23 is taken as a third maximum thickness T3.

The first maximum thickness T1 is the maximum value of the thickness of the first blade 21 in a direction orthogonal to the extension direction of the first blade 21 (i.e., the direction from the first leading edge part 21*a* toward the first trailing edge part 21*b* along the first blade 21) when viewed along the Z-direction. The second maximum thickness T2 is the maximum value of the thickness of the second blade 22 in a direction orthogonal to the extension direction of the second blade 22 (i.e., the direction from the second leading edge part 22*a* toward the second trailing edge part 22*b* along the second blade 22) when viewed along the Z-direction. The third maximum thickness T3 is the maximum value of the thickness of the third blade 23 in a direction orthogonal to the extension direction of the third blade 23 (i.e., the direction from the third leading edge part 23*a* toward the third trailing edge part 23*b* along the third blade 23) when viewed along the Z-direction.

In the centrifugal fan 100 according to the embodiment, for example, the first maximum thickness T1 is less than the second maximum thickness T2. The first maximum thickness T1 is, for example, less than the third maximum thickness T3. The second maximum thickness T2 may be greater than the third maximum thickness T3, equal to the third maximum thickness, or less than the third maximum thickness T3.

The difference between the first maximum thickness T1 and the second maximum thickness T2 is, for example, not less than 0.1 mm and not more than 5 mm. The difference between the first maximum thickness T1 and the third maximum thickness T3 is, for example, not less than 0.1 mm and not more than 5 mm.

For example, by reducing the first placement angle θ1 described above, the maximum pressure applied to the first blade 21 when rotating is less than the maximum pressure applied to the second blade 22 when rotating and the maximum pressure applied to the third blade 23 when rotating. Therefore, the first maximum thickness T1 can be less than the second and third maximum thicknesses T2 and T3. By setting the first maximum thickness T1 to be less than the second and third maximum thicknesses T2 and T3, for example, the material cost can be reduced.

The heights of the first to third blades 21 to 23 will now be described in more detail.

Figure 5:
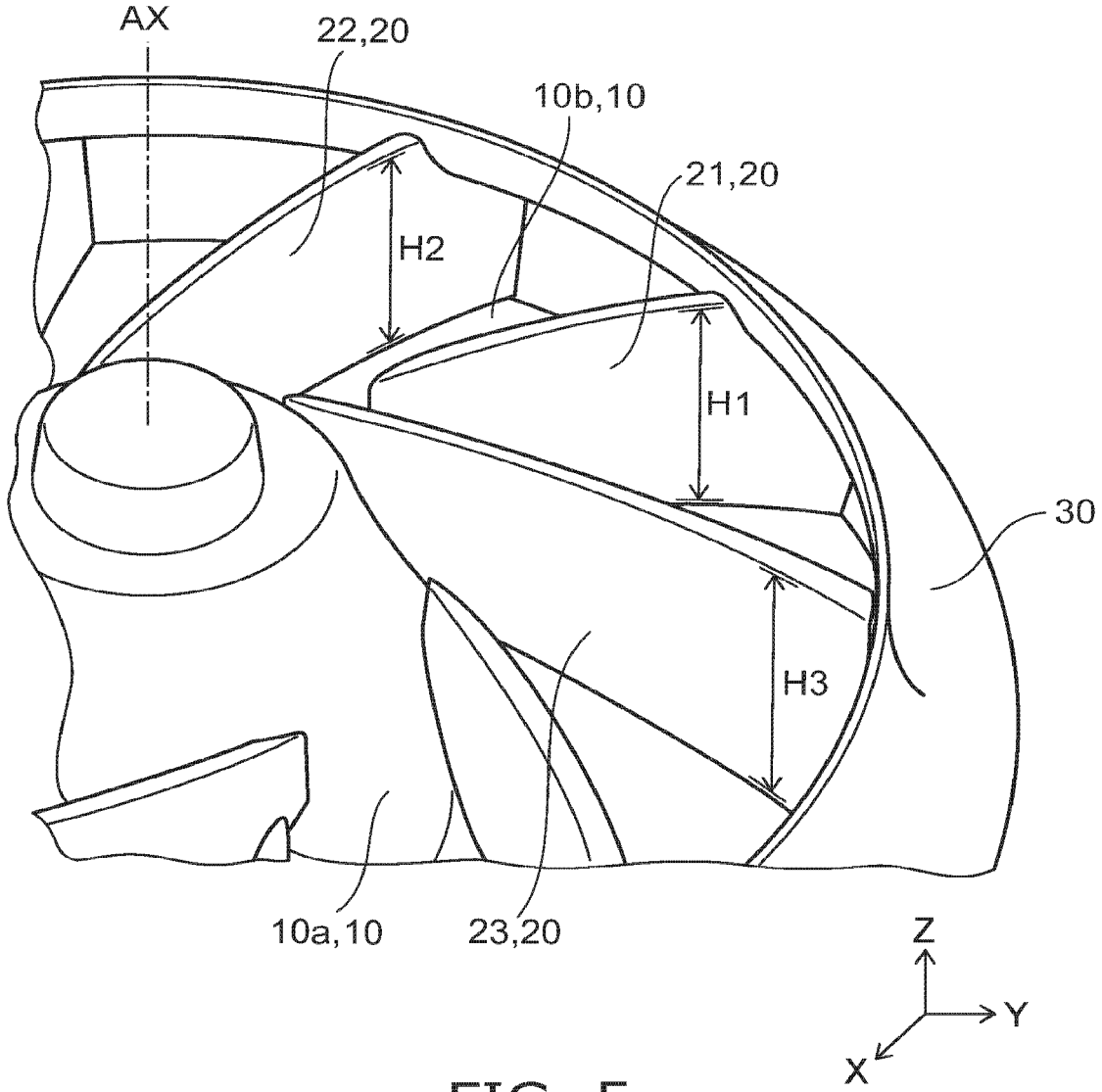
FIG. 5 is a perspective view illustrating the centrifugal fan according to the embodiment.

FIG. 5 is a perspective view illustrating the centrifugal fan according to the embodiment.

As illustrated in FIG. 5, the maximum height of the first blade 21 is taken as a first maximum height H1. The maximum height of the second blade 22 is taken as a second maximum height H2. The maximum height of the third blade 23 is taken as a third maximum height H3.

The first maximum height H1 is the maximum value of the length of the first blade 21 in the extension direction of the rotation axis AX (the Z-direction). The second maximum height H2 is the maximum value of the length of the second blade 22 in the extension direction of the rotation axis AX (the Z-direction). The third maximum height H3 is the maximum value of the length of the third blade 23 in the extension direction of the rotation axis AX (the Z-direction).

In the centrifugal fan 100 according to the embodiment, for example, the second maximum height H2 is less than the first maximum height H1. The third maximum height H3 is less than the first maximum height H1. The second maximum height H2 may be greater than the third maximum height H3, equal to the third maximum height H3, or less than the third maximum height H3.

The difference between the second maximum height H2 and the first maximum height H1 is, for example, not less than 0.1 mm and not more than 1 cm. The difference between the third maximum height H3 and the first maximum height H1 is, for example, not less than 0.1 mm and not more than 1 cm.

For example, at the side edge part (the Z-direction end part) of the second blade 22 and the side edge part (the Z-direction end part) of the third blade 23, airflow separation occurs easily when rotating, and so there is a risk that the load may become too large, and pressure loss may occur. In contrast, by setting the second maximum height H2 and the third maximum height H3 to be less than the first maximum height H1, airflow separation at the side edge part of the second blade 22 and the side edge part of the third blade 23 can be suppressed, so that the load at the side edge part of the second blade 22 and the side edge part of the third blade 23 can be prevented from becoming too large, and the pressure loss can be suppressed.

The mounting angles of the first to third blades 21 to 23 will now be described in more detail.

Figure 6:
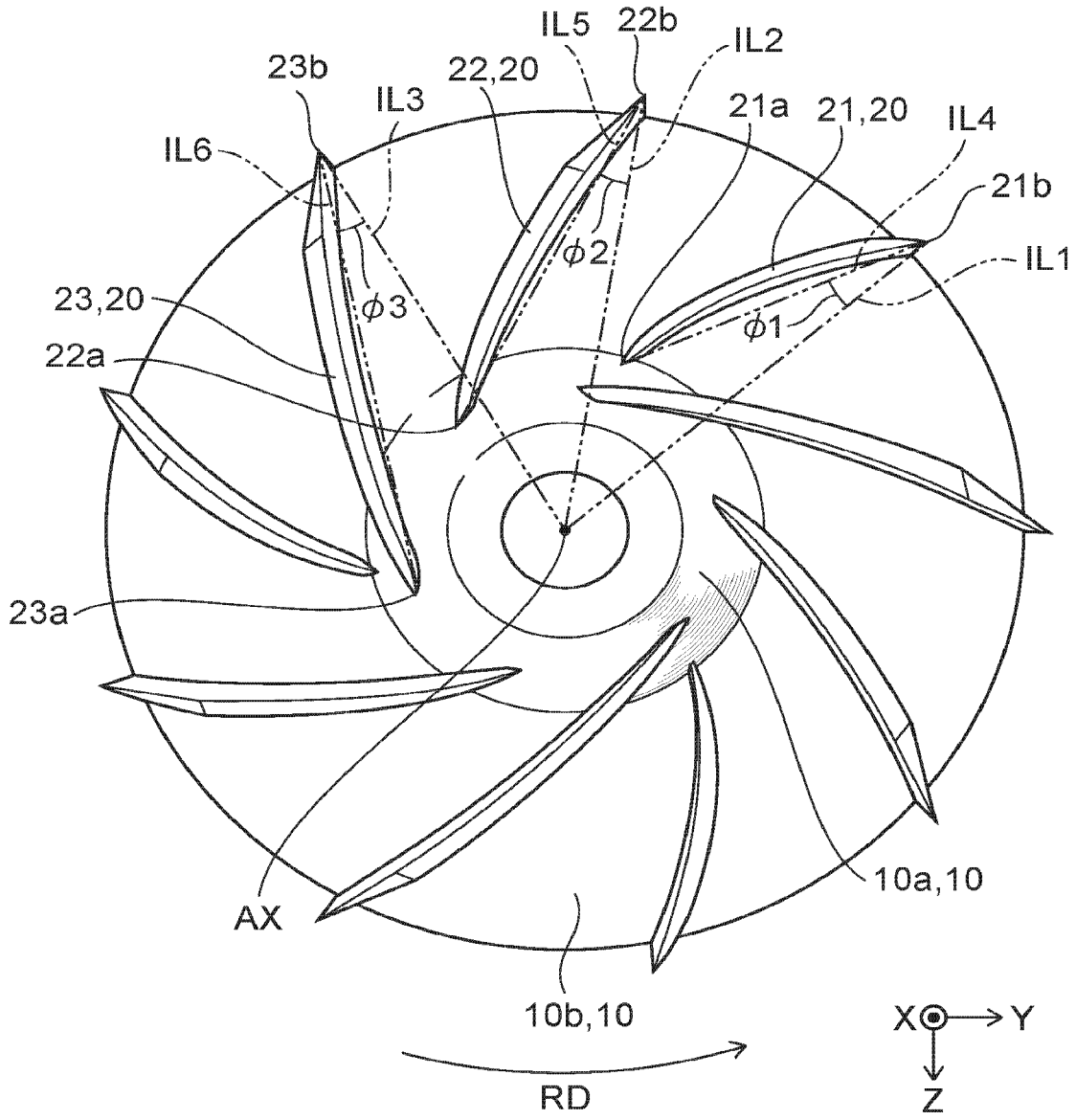
FIG. 6 is a plan view illustrating the centrifugal fan according to the embodiment.

FIG. 6 is a plan view illustrating the centrifugal fan according to the embodiment.

The shroud 30 is not illustrated in FIG. 6.

As illustrated in FIG. 6, the straight line that connects the rotation axis AX and the first trailing edge part 21*b* of the first blade 21 is taken as the first virtual line IL1. The straight line that connects the rotation axis AX and the second trailing edge part 22*b* of the second blade 22 is taken as the second virtual line IL2. The straight line that connects the rotation axis AX and the third trailing edge part 23*b* of the third blade 23 is taken as the third virtual line IL3. The straight line that connects the first trailing edge part 21*b* and the first leading edge part 21*a* of the first blade 21 is taken as a fourth virtual line IL4. The straight line that connects the second trailing edge part 22*b* and the second leading edge part 22*a* of the second blade 22 is taken as a fifth virtual line IL5. The straight line that connects the third trailing edge part 23*b* and the third leading edge part 23*a* of the third blade 23 is taken as a sixth virtual line IL6.

The angle (the minor angle) between the first virtual line IL1 and the fourth virtual line IL4 adjacent to each other is taken as a first mounting angle $\phi$1. The angle (the minor angle) between the second virtual line IL2 and the fifth virtual line IL5 adjacent to each other is taken as a second mounting angle $\phi$2. The angle (the minor angle) between the third virtual line IL3 and the sixth virtual line IL6 adjacent to each other is taken as a third mounting angle $\phi$3.

In the centrifugal fan 100 according to the embodiment, for example, the third mounting angle $\phi$3 is less than at least one of the first mounting angle $\phi$1 or the second mounting angle $\phi$2. For example, when the third mounting angle $\phi$3 is less than the first mounting angle $\phi$1, the third mounting angle $\phi$3 may be greater than the second mounting angle $\phi$2, equal to the second mounting angle $\phi$2, or less than the second mounting angle $\phi$2. For example, when the third mounting angle $\phi$3 is less than the second mounting angle $\phi$2, the third mounting angle $\phi$3 may be greater than the first mounting angle $\phi$1, equal to the first mounting angle $\phi$1, or less than the first mounting angle $\phi$1. The second mounting angle $\phi$2 may be greater than the first mounting angle $\phi$1, equal to the first mounting angle $\phi$1, or less than the first mounting angle $\phi$1. In the example, the third mounting angle $\phi$3 is less than the first mounting angle $\phi$1 and less than the second mounting angle $\phi$2. In the example, the second mounting angle $\phi$2 is equal to the first mounting angle $\phi$1.

When the third mounting angle $\phi$3 is less than the first mounting angle $\phi$1, the difference between the third mounting angle $\phi$3 and the first mounting angle $\phi$1 is, for example, not less than 1° and not more than 5°. When the third mounting angle $\phi$3 is less than the second mounting angle $\phi$2, the difference between the third mounting angle $\phi$3 and the second mounting angle $\phi$2 is, for example, not less than 1° and not more than 5°.

By setting the third mounting angle $\phi$3 to be less than at least one of the first mounting angle $\phi$1 or the second mounting angle $\phi$2, the flow path between the first blade 21 and the third blade 23 tends to be less narrow than when the third mounting angle $\phi$3 is not less than the first mounting angle $\phi$1 or when the third mounting angle $\phi$3 is not less than the second mounting angle $\phi$2; therefore, the flow path resistance does not increase easily in the flow path between the first blade 21 and the third blade 23. The static pressure can be increased thereby.

Embodiments may include the following configurations.

Configuration 1

A centrifugal fan, comprising:

a back plate rotating around a rotation axis;

a shroud; and a plurality of blades located between the back plate and the shroud, the back plate including a central part and an outer circumference part, the outer circumference part being positioned outward of the central part, the plurality of blades including a first blade, a second blade, and a third blade, the first blade including a first leading edge part, the first leading edge part being an end part at the central part side, and a first trailing edge part, the first trailing edge part being an end part at the outer circumference part side, the second blade including a second leading edge part, the second leading edge part being an end part at the central part side, and a second trailing edge part, the second trailing edge part being an end part at the outer circumference part side, the third blade including a third leading edge part, the third leading edge part being an end part at the central part side, and a third trailing edge part, the third trailing edge part being an end part at the outer circumference part side, a first length being a length from the first leading edge part to the first trailing edge part, a second length being a length from the second leading edge part to the second trailing edge part, a third length being a length from the third leading edge part to the third trailing edge part, the second length being greater than the first length, the third length being greater than the second length, a number of the first blades, a number of the second blades, and a number of the third blades being equal, a total number of the plurality of blades being a multiple of 3, and being not less than 6, the first blade, the second blade, and the third blade being arranged in a rotation direction in an order of the first blade, the second blade, and the third blade.

Configuration 2

The fan according to configuration 1, wherein a first virtual line is a straight line connecting the rotation axis and the first trailing edge part, a second virtual line is a straight line connecting the rotation axis and the second trailing edge part, a third virtual line is a straight line connecting the rotation axis and the third trailing edge part, a first placement angle is an angle between the first virtual line and the second virtual line adjacent to each other, a second placement angle is an angle between the second virtual line and the third virtual line adjacent to each other, a third placement angle is an angle between the third virtual line and the first virtual line adjacent to each other, and the third placement angle is greater than at least one of the first placement angle or the second placement angle.

Configuration 3

The fan according to configuration 1 or 2, wherein a first maximum thickness is a maximum thickness of the first blade in a direction orthogonal to an extension direction of the first blade, a second maximum thickness is a maximum thickness of the second blade in a direction orthogonal to an extension direction of the second blade, a third maximum thickness is a maximum thickness of the third blade in a direction orthogonal to an extension direction of the third blade, the first maximum thickness is less than the second maximum thickness, and the first maximum thickness is less than the third maximum thickness.

Configuration 4

The fan according to any one of configurations 1 to 3, wherein a first maximum height is a maximum height of the first blade in an extension direction of the rotation axis, a second maximum height is a maximum height of the second blade in the extension direction of the rotation axis, a third maximum height is a maximum height of the third blade in the extension direction of the rotation axis, the second maximum height is less than the first maximum height, and the third maximum height is less than the first maximum height.

Configuration 5

The fan according to any one of configurations 1 to 4, wherein a first virtual line is a straight line connecting the rotation axis and the first trailing edge part, a second virtual line is a straight line connecting the rotation axis and the second trailing edge part, a third virtual line is a straight line connecting the rotation axis and the third trailing edge part, a fourth virtual line is a straight line connecting the first trailing edge part and the first leading edge part, a fifth virtual line is a straight line connecting the second trailing edge part and the second leading edge part, a sixth virtual line is a straight line connecting the third trailing edge part and the third leading edge part, a first mounting angle is an angle between the first virtual line and the fourth virtual line adjacent to each other, a second mounting angle is an angle between the second virtual line and the fifth virtual line adjacent to each other, a third mounting angle is an angle between the third virtual line and the sixth virtual line adjacent to each other, and the third mounting angle is less than at least one of the first mounting angle or the second mounting angle.

Thus, according to embodiments, a centrifugal fan is provided in which the static pressure can be increased while suppressing vibrations when rotating; and an increase of the material cost can be suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions. Embodiments described above can be implemented in combination with each other.

What is claimed is:

1. A centrifugal fan, comprising:

a back plate rotating around a rotation axis;

a shroud; and a plurality of blades located between the back plate and the shroud, the back plate including a central part and an outer circumference part, the outer circumference part being positioned outward of the central part, the plurality of blades including a first blade, a second blade, and a third blade, the first blade including a first leading edge part, the first leading edge part being an end part at the central part side, and a first trailing edge part, the first trailing edge part being an end part at the outer circumference part side, the second blade including a second leading edge part, the second leading edge part being an end part at the central part side, and a second trailing edge part, the second trailing edge part being an end part at the outer circumference part side, the third blade including a third leading edge part, the third leading edge part being an end part at the central part side, and a third trailing edge part, the third trailing edge part being an end part at the outer circumference part side, a first length being a length from the first leading edge part to the first trailing edge part, a second length being a length from the second leading edge part to the second trailing edge part, a third length being a length from the third leading edge part to the third trailing edge part, the second length being greater than the first length, the third length being greater than the second length, a number of the first blades, a number of the second blades, and a number of the third blades being equal, a total number of the plurality of blades being a multiple of 3, and being not less than 6, the first blade, the second blade, and the third blade being arranged in a rotation direction in an order of the first blade, the second blade, and the third blade, a first virtual line is a straight line connecting the rotation axis and the first trailing edge part, a second virtual line is a straight line connecting the rotation axis and the second trailing edge part, a third virtual line is a straight line connecting the rotation axis and the third trailing edge part, a fourth virtual line is a straight line connecting the first trailing edge part and the first leading edge part, a fifth virtual line is a straight line connecting the second trailing edge part and the second leading edge part, a sixth virtual line is a straight line connecting the third trailing edge part and the third leading edge part, a first mounting angle is an angle between the first virtual line and the fourth virtual line adjacent to each other, a second mounting angle is an angle between the second virtual line and the fifth virtual line adjacent to each other, a third mounting angle is an angle between the third virtual line and the sixth virtual line adjacent to each other, and the third mounting angle is less than at least one of the first mounting angle and the second mounting angle.

2. The fan according to claim 1, wherein a first placement angle is an angle between the first virtual line and the second virtual line adjacent to each other, a second placement angle is an angle between the second virtual line and the third virtual line adjacent to each other, a third placement angle is an angle between the third virtual line and the first virtual line adjacent to each other, and the third placement angle is greater than at least one of the first placement angle and the second placement angle.

3. The fan according to claim 1, wherein a first maximum thickness is a maximum thickness of the first blade in a direction orthogonal to an extension direction of the first blade, a second maximum thickness is a maximum thickness of the second blade in a direction orthogonal to an extension direction of the second blade, a third maximum thickness is a maximum thickness of the third blade in a direction orthogonal to an extension direction of the third blade, the first maximum thickness is less than the second maximum thickness, and the first maximum thickness is less than the third maximum thickness.

4. The fan according to claim 1, wherein a first maximum height is a maximum height of the first blade in an extension direction of the rotation axis, a second maximum height is a maximum height of the second blade in the extension direction of the rotation axis, a third maximum height is a maximum height of the third blade in the extension direction of the rotation axis, the second maximum height is less than the first maximum height, and the third maximum height is less than the first maximum height.

* * * * *